US008562392B2

(12) United States Patent
Shiratani et al.

(10) Patent No.: US 8,562,392 B2
(45) Date of Patent: Oct. 22, 2013

(54) POLISHING APPARATUS AND POLISHING METHOD

(75) Inventors: Masafumi Shiratani, Kanagawa (JP); Shigeyuki Yoshida, Kanagawa (JP); Osamu Ito, Kanagawa (JP)

(73) Assignee: Renesas Electronics Corporation, Kawasaki-Shi, Kanagawa (JP)

( * ) Notice: Subject to any disclaimer, the term of this patent is extended or adjusted under 35 U.S.C. 154(b) by 502 days.

(21) Appl. No.: 12/662,340

(22) Filed: Apr. 12, 2010

(65) Prior Publication Data

US 2010/0273401 A1 Oct. 28, 2010

(30) Foreign Application Priority Data

Apr. 27, 2009 (JP) ..... 2009-108192

(51) Int. Cl.
*B24B 1/00* (2006.01)

(52) U.S. Cl.
USPC ..... 451/56; 451/443; 451/444

(58) Field of Classification Search
USPC ..... 451/41, 56, 443, 444, 285–290
See application file for complete search history.

(56) References Cited

U.S. PATENT DOCUMENTS 5,839,947 A * 11/1998 Kimura et al. ..... 451/288
6,217,430 B1 * 4/2001 Koga et al. ..... 451/444
6,358,124 B1 * 3/2002 Koga et al. ..... 451/56
6,488,573 B1 * 12/2002 Kobayashi et al. ..... 451/285
6,609,962 B1 * 8/2003 Nabeya et al. ..... 451/443
6,634,934 B1 * 10/2003 Akaike ..... 451/56
7,025,663 B2 * 4/2006 Kim ..... 451/285

FOREIGN PATENT DOCUMENTS

JP 9-254017(A) 9/1997
JP 9-254018 A 9/1997
JP 3708740 B2 10/2005

OTHER PUBLICATIONS

Japanese Office Action dated Jun. 4, 2013 with partial English translation thereof.

* cited by examiner

*Primary Examiner* — Maurina Rachuba

(74) *Attorney, Agent, or Firm* — McGinn Intellectual Property Law Group, PLLC

(57) ABSTRACT

A polishing apparatus includes a polishing table with a polishing pad at an upper surface, and a conditioning disc carrying out conditioning of the polishing pad, and a moving mechanism (constructed, for example, from a swing arm) capable of moving the conditioning disc to a standby position above the polishing pad, and a spraying mechanism (constructed, for example, from a washing water nozzle) that sprays liquid to the conditioning disc positioned at the standby position so as to wash or wet the conditioning disc.

20 Claims, 9 Drawing Sheets

POLISHING APPARATUS AND POLISHING METHOD

This application is based on Japanese patent application No. 2009-108192 the content of which is incorporated hereinto by reference.

BACKGROUND

1. Technical Field

The present invention relates to a polishing apparatus and a polishing method.

2. Related Art

Polishing of a polished surface of a wafer is carried out in, for example, a CMP (Chemical Mechanical Polish) step of a semiconductor manufacturing process using CMP polishing apparatus.

Polishing apparatus illustrated in FIG. 11 are disclosed in Japanese Laid-Open Patent Publication No. H9-254018. The polishing apparatus illustrated in FIG. 11 is equipped with a polishing table 201, a support unit 202 for supporting the subject of polishing, a dressing tool (corresponding to a conditioning disc) 203, a nozzle 204 for spraying water in order to clean or wet the support unit 202, and a nozzle 205 for spraying water in order to clean or wet the dressing tool 203. The nozzles 204, 205 are located to the side of the polishing table 201 at a position lower than the upper surface of the polishing table 201. During washing or wetting of the support unit 202 and the dressing tool 203, as shown in FIG. 11, the support unit 202 and the dressing tool 203 are moved to positions to the side of the polishing table 201 lower than the upper surface of the polishing table 201.

Polishing apparatus illustrated in FIG. 12 are disclosed in Japanese Laid-Open Patent Publication No. 2000-263417. This polishing apparatus includes a polishing table 301, a polishing pad 302 located above the polishing table 301, a slurry supply tube 303, a support unit 305 for supporting a wafer 304, a dresser (corresponding to a conditioning disc) 307 having the brush 306 at a lower surface, and a washing mechanism 308 for washing the brush 306. At this polishing apparatus, as illustrated in FIG. 12, the brush 306 projects from the polishing table 301 and is washed by the washing mechanism 308 from below both during and after polishing.

Polishing apparatus illustrated in FIG. 13 are also disclosed Japanese Laid-Open Patent Publication No. 2000-263417. This polishing apparatus is equipped with a polishing table, a polishing pad 302 located above the polishing table, a slurry supply tube 303, a support unit 305 supporting the wafer 304, a dresser 307 having a brush 306 at a lower surface, and a nozzle 309 for spraying water under high pressure in order to wash the brush 306. As shown in FIG. 13, this polishing apparatus washes the brush 306 by spraying water under high pressure onto the brush 306 from the nozzle 309 located to the side of the brush 306 that performs conditioning on the polishing pad 302.

However, with the polishing apparatus of Japanese Laid-Open patent publication No. H9-254018 (FIG. 11), it is necessary for the dressing tool 203 to be moved to a position lower than the upper surface of the polishing table 201 to the side of the polishing table 201 every time the conditioning disc is washed or wetted. This means that substantial amount of time is required to move the dressing tool 203 for washing or wetting.

In Japanese Laid-Open Patent Publication No. 2000-263417, washing is carried out mainly while carrying out conditioning with the brush 306 in contact with the polishing pad 302 with the structures for either of FIG. 12 or 13. This means that when fixed matter within the slurry becomes affixed to the brush 306, the fixed matter is swept out to the side of the subject of polishing (wafer etc.) by the brush 306 during washing and causes the subject of polishing to become scratched.

It is therefore extremely difficult to achieve a situation where both the time required to move the conditioning disc in order that the conditioning disc is washed or wetted is made short and the occurrence of scratches on a subject of polishing such as a wafer is sufficiently suppressed.

SUMMARY

According to the present invention, there is provided a polishing apparatus comprising a polishing table with a polishing pad on an upper surface, a support unit supporting a subject of polishing while polishing the subject of polishing so that the subject of polishing comes into contact with the polishing pad, a conditioning disc carrying out conditioning of said polishing pad, a moving mechanism moving the conditioning disc towards a standby position above the polishing pad, and a spraying mechanism spraying liquid to the conditioning disc positioned at the standby position so as to wash or wet the conditioning disc.

According to the present invention, it is possible to wash or wet the conditioning disc, and it is possible to suppress slurry from becoming affixed to the conditioning disc. It is therefore possible to suppress the occurrence of scratches at the wafer caused by the falling of fixed matter.

It is also possible to spray liquid to the conditioning disc with the conditioning disc moved to the standby position above the polishing pad and to wash or wet the conditioning disc. It is also therefore possible to dramatically reduce the time required to move the conditioning disc in order to wash or wet the conditioning disc compared to the case of moving the conditioning disc to the side of the polishing table to a position lower than the upper surface of the polishing table every time the conditioning disc is washed or wetted (Japanese Laid-Open patent publication No. H9-254018). A point of difference with the structure where a brush comes into contact with the polishing pad and washing is then carried out during the conditioning operation (Japanese Laid-Open Patent Publication No. 2000-263417.) is that when fixed matter in the slurry becomes affixed to the conditioning disc, this fixed matter is swept away to the side of the subject of polishing by the conditioning disc while liquid is sprayed by the spraying mechanism and the problem where scratches occur on the subject of polishing is therefore avoided. It is therefore possible to sufficiently suppress the occurrence of scratches on the subject of polishing.

It is therefore also possible to achieve a situation where both the time required to move the conditioning disc in order that the conditioning disc is washed or wetted is made short and the occurrence of scratches on a subject of polishing such as a wafer is sufficiently suppressed.

According to the present invention, there is also provided a polishing method comprising: bringing a subject of polishing into contact with a polishing pad provided on an upper surface of a polishing table so as to polish said subject of polishing, conditioning the polishing pad using a conditioning disc, moving the conditioning disc to a standby position above the polishing pad, and spraying liquid to the conditioning disc positioned at the standby position so as to wash or wet the conditioning disc.

According to the present invention, it is therefore possible to achieve a situation where both the time required to move the conditioning disc for washing and wetting is made short and the occurrence of scratches on a subject of polishing such as a wafer is sufficiently suppressed.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION

Before describing of the present invention, the related art will be explained in detail with reference to FIGS. 9 and 10 in order to facilitate the understanding of the present invention.

Figure 9:
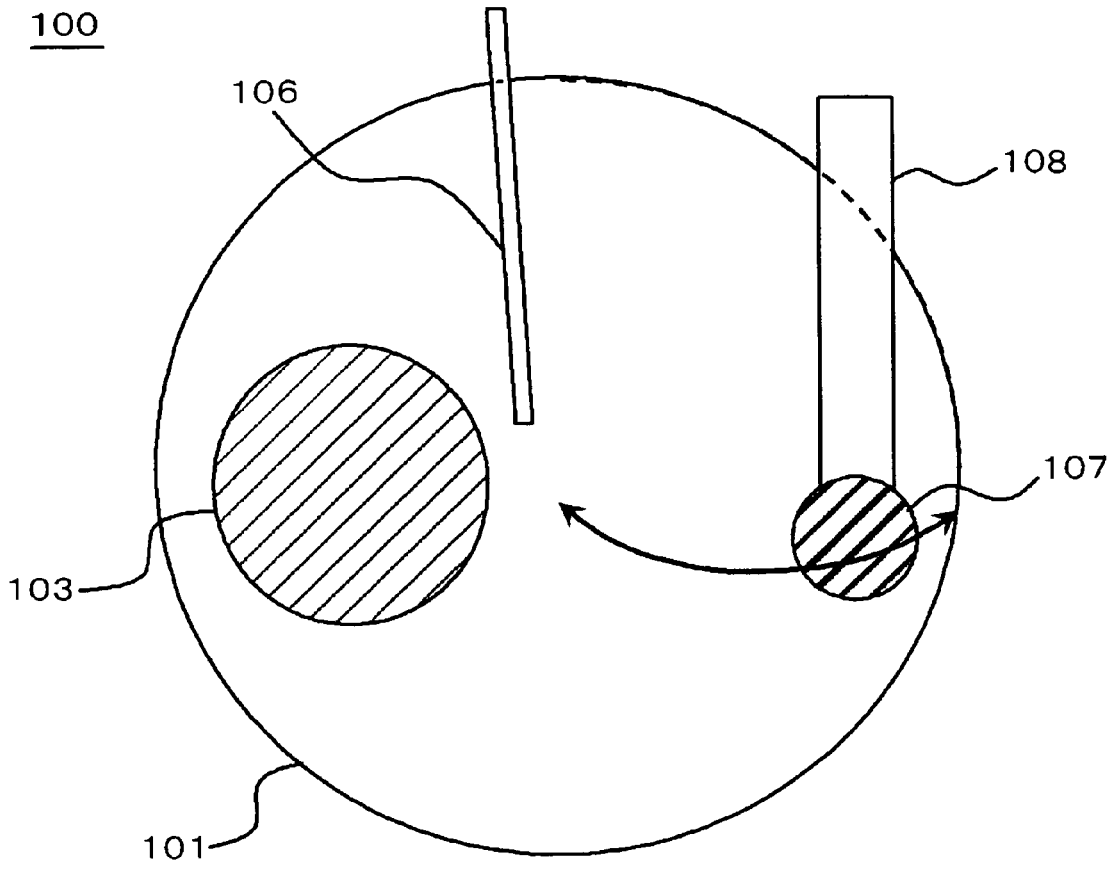
FIG. 9 is a plan view in cross-section of a comparative example of a CMP polishing apparatus.
Figure 10:
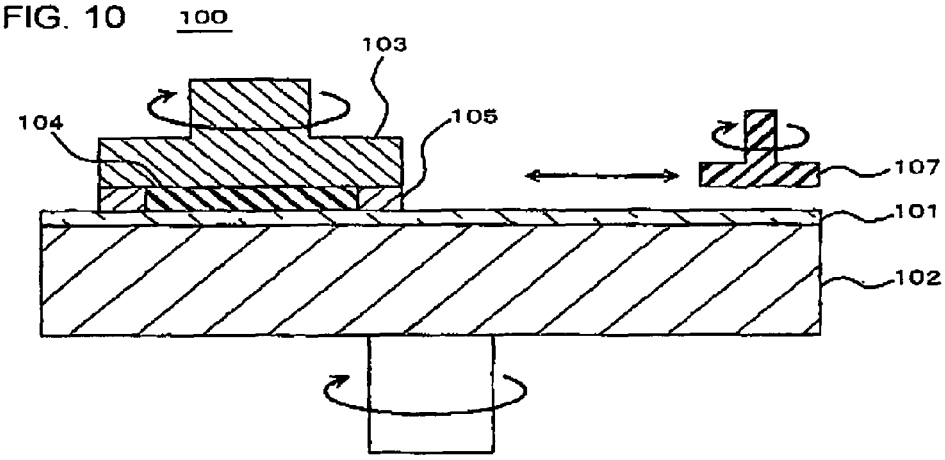
FIG. 10 is a plan view in cross-section of the CMP polishing apparatus of FIG. 9.
Figure 11:
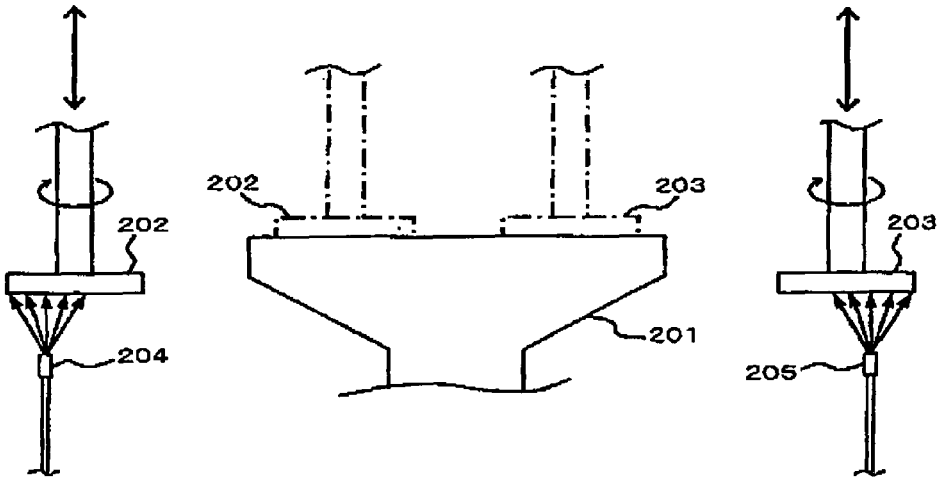
FIG. 11 RELATED ART
FIG. 11 is a front view of the polishing apparatus disclosed in Japanese Laid-Open patent publication No. H9-254018.

FIGS. 9 and 10 are views illustrating comparative examples of a CMP polishing apparatus 100, where FIG. 9 is a plan view in cross-section and FIG. 10 is a front view in cross-section.

As shown in FIGS. 9 and 10, a CMP polishing apparatus 100 is equipped with a polishing table 102 that has a polishing pad 101 on an upper surface, a polishing head 103 that has a retainer ring 105 for supporting a wafer 104 on a lower surface, a slurry nozzle 106, a conditioning disc 107, and a swing arm 108, supporting the conditioning disc 107 at a tip so as to swing.

Polishing of the wafer 104 is carried out by dripping slurry discharged by the slurry nozzle 106 onto the polishing pad 101 and then rotating a wafer 104 about the polishing head 103 in this state where a surface of the wafer 104 supported by the polishing head 103 that is to be polished presses against the polishing pad 101.

As the polishing advances, polishing waste (waste cut away from the wafer 104, the polishing pad 101, and the retainer ring 105) or aggregate of the slurry etc. clogs up grooves or holes formed on the polishing pad 101 or pores in the material itself constituting the polishing pad 101. And the surface of the polishing pad 101 then becomes smoother as the polishing progresses. The polishing rate therefore falls as the polishing advances as a result of the polishing pad 101 becoming clogged up and the surface of the polishing pad 101 becoming smoother.

Conditioning (so-called "sharpening") of the polishing pad 101 can be carried out in order to suppress falls in the polishing rate using the conditioning disc 107 which typically has a diamond abrasive grain fitted. The conditioning disc 107 can be referred to as a "conditioner".

Carrying out conditioning between polishing of one wafer 104 and polishing off the next wafer 104 is referred to as "ex-situ conditioning". Performing conditioning in parallel with the polishing in order to not lower the processing efficiency of the CMP polishing apparatus 100 is referred to as "in-situ conditioning".

However, the slurry contains abrasive grain such as silica. This abrasive grain therefore becomes a fixed to the conditioning disc 107. When this fixed matter then comes away from the conditioning disc 107 and falls onto the polishing pad 101, this causes scratches (polishing blemishes) to occur on the wafer 104.

The technology for taking these problems into account is the technology of, for example, Japanese Laid-Open Patent Publications No. H9-254018 and No. 2000-263417. However, it is extremely difficult with the technology of Japanese Laid-Open Patent Publications No. H9-254018 and No. 2000-263417 to achieve a situation where both the time required to move the conditioning disc in order that the conditioning disc is washed or wetted is made short and the occurrence of scratches on a subject of polishing such as a wafer is sufficiently suppressed.

The invention will be now described herein with reference to illustrative embodiments. Those skilled in the art will recognize that many alternative embodiments can be accomplished using the teachings of the present invention and that the invention is not limited to the embodiments illustrated for explanatory purposes.

Embodiments of the present invention will be explained below, referring to the attached drawings. Note that any similar constituents will be given the same reference numerals or symbols in all drawings, and explanations therefor will not be repeated.

[First Embodiment]

Figure 1:
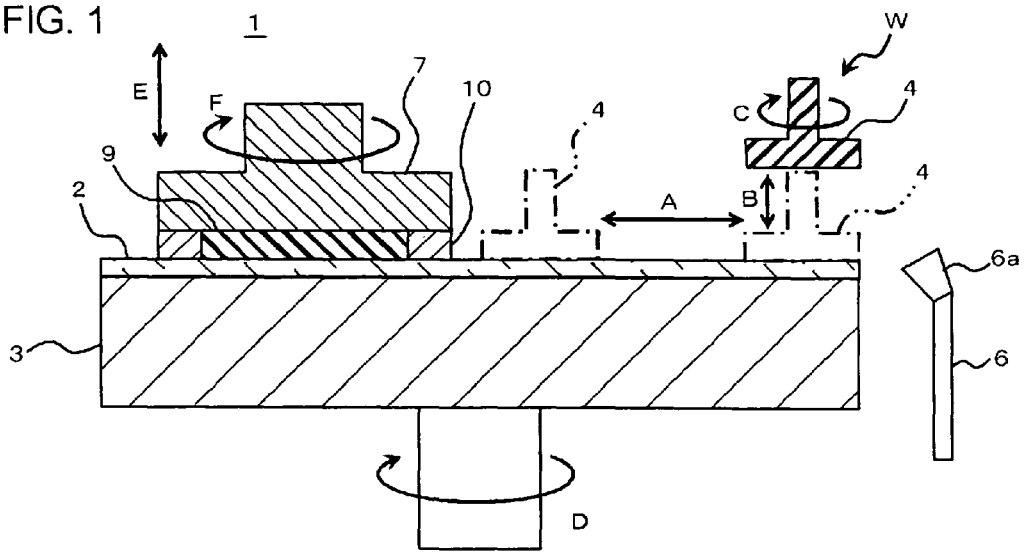
FIG. 1 is a front view in cross-section of a CMP polishing apparatus of a first embodiment.
Figure 2:
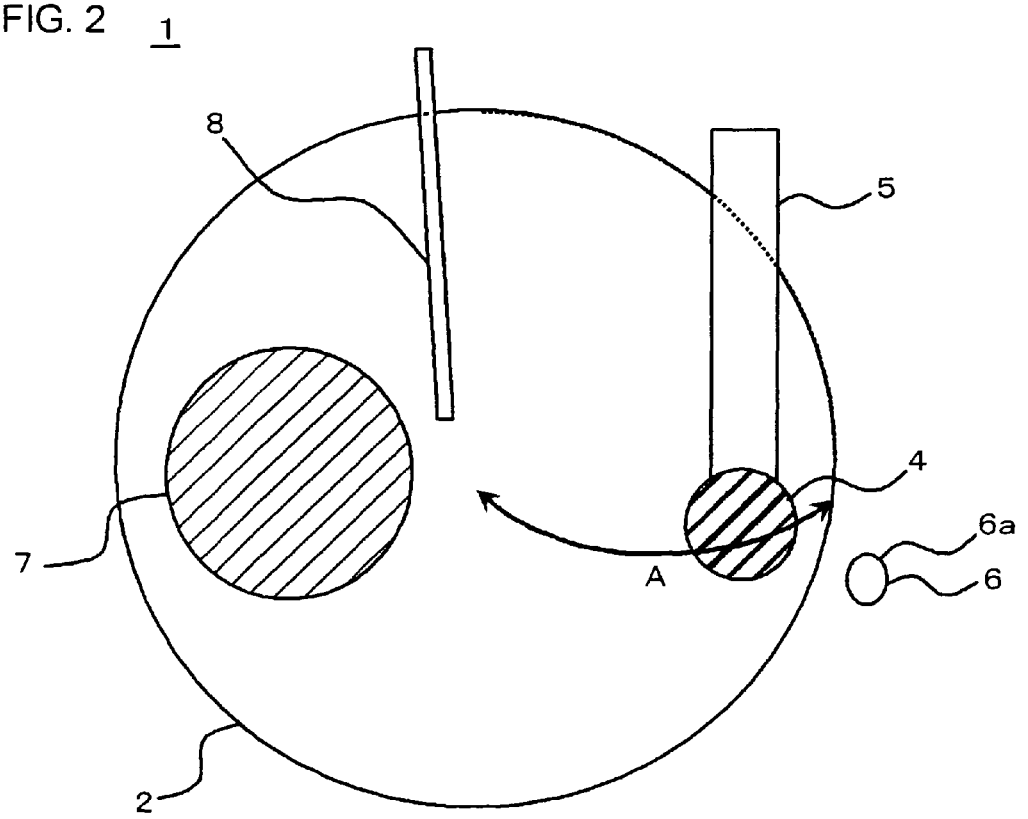
FIG. 2 is a plan view in cross-section of the CMP polishing apparatus of the first embodiment.
Figure 3:
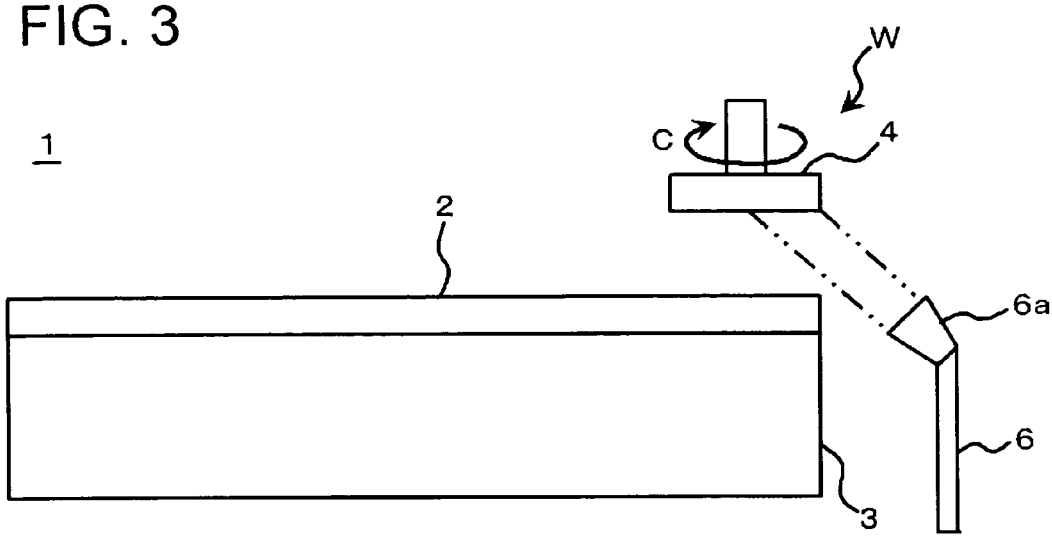
FIG. 3 is a front view illustrating the situation at the time of washing the conditioning disc of the CMP polishing apparatus of the first embodiment.
Figure 4:
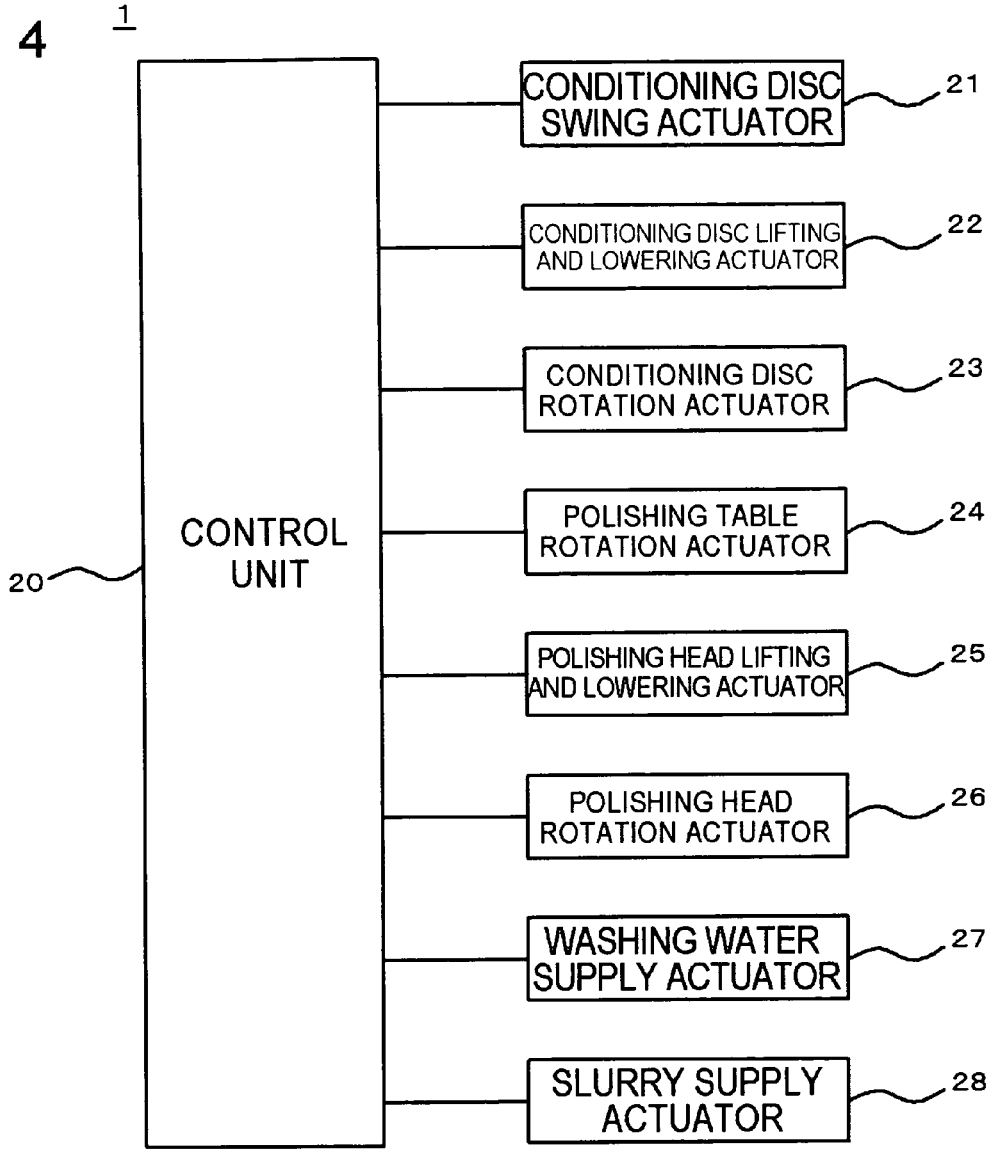
FIG. 4 is a block diagram of control for the CMP polishing apparatus of the first embodiment.
Figure 5A:
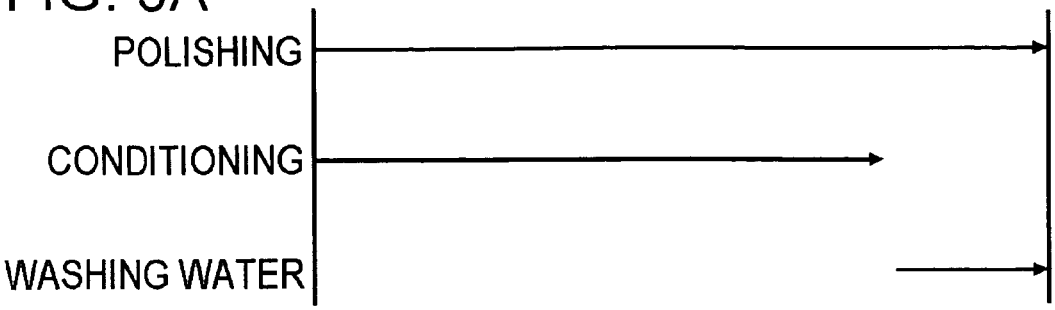
FIGS. 5A, 5B, and 5C are timing charts illustrating a polishing operation.
Figure 5B:
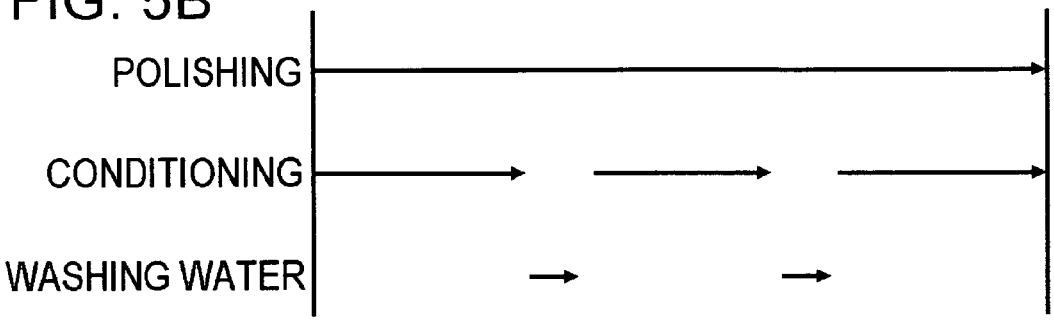
Figure 5C:
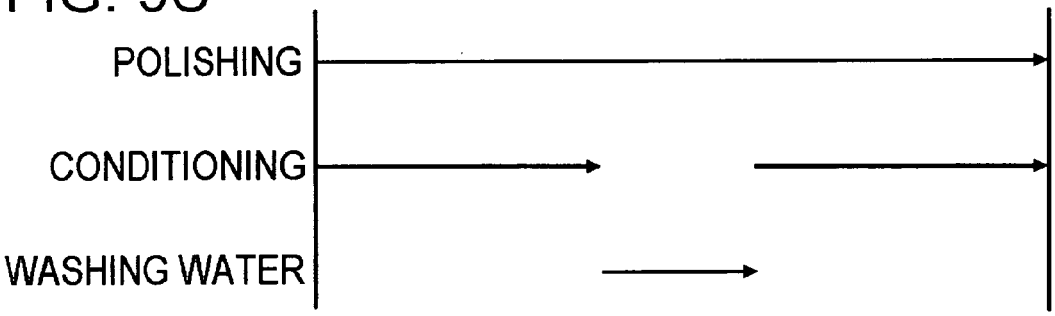

FIG. 1 is a front view in cross-section of a CMP polishing apparatus 1 of a first embodiment, FIG. 2 is a plan view in cross-section of the CMP polishing apparatus 1, FIG. 3 is a front view illustrating a situation when washing a conditioning disc 4 the CMP polishing apparatus 1 is provided with, FIG. 4 is a block diagram of control of the CMP polishing apparatus 1, and FIGS. 5A, 5B, and 5C are timing charts illustrating the polishing operation performed by the CMP polishing device 1.

The polishing apparatus (for example, the CMP polishing apparatus 1) of this embodiment includes a polishing table 3 with a polishing pad 2 on an upper surface, a support unit (polishing head 7) for supporting the subject of polishing while polishing the subject of polishing (for example, wafer 9) so that the subject of polishing comes into contact with the polishing pad 2, a conditioning disc 4 for carrying out to conditioning of the polishing pad 2, a moving mechanism (including, for example, a swing arm 5, a conditioning disc swing actuator 21, and a conditioning disc lifting and lowering actuator 22) capable of moving the conditioning disc 4 to a standby position W above the polishing pad 2, and a injection mechanism (including, for example, a washing water nozzle 6 and a washing water supply actuator 27) for injecting liquid (for example, washing water) to the conditioning disc 4 positioned at the standby position W, for washing or wetting the conditioning disc 4. A polishing method of this embodiment is provided with bringing the subject of polishing (for example, the wafer 9) into contact with the polishing pad 2 provided on the upper surface of the polishing table 3 so as to polish the subject of polishing, conditioning the polishing pad 2 using the conditioning disc 4, moving the conditioning disc 4 to a standby position W above the polishing pad 2, and spraying a liquid (for example, washing water) to the conditioning disc 4 positioned at the standby position W so as to wash or wet the conditioning disc 4. A detailed explanation is provided below.

First, an explanation is given of the configuration of the CMP polishing apparatus 1.

As shown in FIGS. 1 and 2, the CMP polishing apparatus 1 includes the polishing table 3 having a polishing pad 2 at an upper surface, the conditioning disc 4, the swing arm 5, the washing water nozzle 6, the polishing head 7, and the slurry nozzle 8.

The polishing head 7 has a retainer ring 10 that supports the wafer 9 at a lower surface. The slurry nozzle 8 discharges slurry onto the polishing pad 2.

The conditioning disc 4 is for conditioning (so-called sharpening) the polishing pad 2.

The swing arm 5 supports the conditioning disc 4 at a tip thereof. By swinging in a direction along arrow A of FIG. 2 in a state where the conditioning disc 4 is in contact with the polishing pad 2, the swing arm 5 is capable of moving the conditioning disc 4 in an arc along the direction of arrow A with the conditioning disc 4 remaining in contact with the polishing pad 2. Namely, the swing arm 5 is capable of moving the conditioning disc 4 that is in contact with the polishing pad 2 from the centre portion of the polishing pad 2 to the edge portion of the polishing pad 2.

The swing arm 5 is also capable of lifting and lowering the conditioning disc 4 in the direction of arrow B of FIG. 1 at, for example, the edge portion of the polishing pad 2. It is therefore possible to move the conditioning disc 4 to the standby position W illustrated in FIG. 1 by lifting the conditioning disc 4. Namely, in the case of this embodiment, the standby position W for the conditioning disc 4 is, for example, above the edge portion of the polishing pad 2.

The swing arm 5 is, for example, also capable of rotating the conditioning disc 4 in a plate-face direction (the direction of arrow C in FIG. 1) at the standby position W. This is to say that the conditioning disc 4 rotates about an axis passing through the centre of the conditioning disc 4 that is orthogonal to the plate surface of the conditioning disc 4. The swing arm 5 is also capable of rotating the conditioning disc 4 even during conditioning. This rotation operation is carried out by a conditioning disc rotation actuator 23 (described later) the swing arm 5 is provided with.

The washing water nozzle 6 is located at the side of the polishing table 3 close to the polishing table 3 and is also located at positioned close to the standby position W. As illustrated, for example, in FIG. 3, the washing water nozzle 6 washes the conditioning disc 4 by spraying washing water (liquid) at an incline upwards from the side of the polishing table 3 towards the conditioning disc 4 positioned at the standby position W. A spraying outlet 6*a* of the washing water nozzle 6 is inclined towards the polishing table 3 and face upwards at an incline so as to enable spraying of the washing water upwards at an incline. It is preferable to set an angle of inclination of the spraying outlet 6*a* so that washing water exceeds the end on the side of the centre of the polishing table 3. of the conditioning disc 4 at the standby position W so as not to splash onto the polishing pad 2. A setting for the supply of the washing water (amount of water, water pressure) is preferably set that the washing water is not excessively splashed onto the polishing pad 2 so as not to lower the polishing rate. Injection of the washing water from the washing water nozzle 6 is only carried out, for example, when the conditioning disc 4 is positioned at the standby position W.

As shown, for example, in FIG. 3, in the case of this embodiment, the centre of the conditioning disc 4 in the standby position W is positioned above the polishing pad 2. Specifically, the whole of the conditioning disc 4 is positioned above the polishing pad 2 in the standby position W.

Flying off of the washing water to the polishing area on the polishing pad 2 (the area where polishing of the wafer 9 supported by the polishing head 7) invites a lowering in the polishing rate. The direction of injection of the washing water is therefore set appropriately according to the standby position W of the conditioning disc 4. In the case of this embodiment, as shown in FIG. 3, the centre of the conditioning disc 4 is positioned above the polishing pad 2, but in this case, it is possible to only wash portions on the outside from the centre of the conditioning disc 4. Namely, the washing water nozzle 6 only sprays the washing water onto portions of the conditioning disc 4 where the distance from a center of the polishing table 3 is equal to or longer than the distance between the center of the polishing table 3 and the center of the conditioning disc 4. The conditioning disc 4 is also rotating at the standby position W. This means that the entire surface of the conditioning disc 4 can be washed with the washing water by only spraying washing water on that portion.

Polishing of the wafer 9 by the polishing head 7 is preferably carried out for portions excluding the edge portions on the polishing table 3 (portions more towards the centre than the edge portions). The conditioning disc 4 is positioned above the polishing table 3 during washing. Therefore, the washing water falls onto the polishing table 3 from the conditioning disc 4 but the washing water only falls on the edge portions of the polishing table 3. This means that polishing of the wafer 9 at positions further towards the centre of the polishing table 3 than the edge portions of the polishing table 3 is not impaired.

As shown in FIG. 4, CMP polishing apparatus 1 includes a control unit 20 and various actuators 21 to 28 operated under the control of the control unit 20. Of these, a conditioning disc swing actuator 21 comprises, for example, a motor, and swings the swing arm 5 along a horizontal plane (along the direction of the arrow A of FIGS. 1 and 2). A conditioning disc lifting and lowering actuator 22 comprises, for example, a motor, and causes the conditioning disc 4 to up and down vertically (in the direction of the arrow B in FIG. 1). A conditioning disc rotation actuator (rotation mechanism) 23 comprises, for example, a motor, and causes the conditioning disc 4 to rotate in a plate direction (in the direction of the arrow C in FIGS. 1 and 3). In the case of this embodiment, the conditioning disc 4 rotates within a horizontal plane. A polishing table rotation actuator 24 is comprised of, for example, a motor, and causes the polishing table 3 to rotate within a horizontal plane (rotate in the direction of arrow D of FIG. 1). A polishing table lifting and lowering actuator 25 is comprised of, for example, a motor, and causes the polishing head 7 to up and down vertically (in the direction of arrow E in FIG. 1). A polishing head rotation actuator 26 is comprised of, for example, a motor, and causes the polishing head 7 to rotate within a horizontal plane (rotate in the direction of arrow F of FIG. 1). A washing water supply actuator 27 is comprised of, for example, a pump or a motor, and sprays washing water from a spraying outlet 6*a* of the washing water nozzle 6. A slurry supply actuator 28 is comprised of, for example, a pump or a motor, and discharges (drips) slurry from the slurry nozzle 8 onto the polishing pad 2. The control unit 20 includes a CPU (Central Processing Unit) for carrying out various control processing, a ROM (Read Only Memory) storing programs for the operation of the CPU, and a RAM (Random Access Memory) functioning as a work a region etc. for the CPU. And the control unit 20 carries out control of the operation of each of the actuators 21 to 28.

The operation is now described.

Polishing of the wafer 9 is carried out by bringing the polishing head 7 down so that the wafer 9 presses against the polishing pad 2 in a state where the wafer 9 is supported by a retainer ring 10 of the polishing head 7. Slurry is then dropped from the slurry nozzle 8 onto the polishing pad 2 and the polishing head 7 and the polishing table 3 are caused to rotate.

The conditioning operation of the polishing pad 2 by the conditioning disc 4 is carried out by lowering the conditioning disc 4 so as to press against the polishing pad 2 and rotating the conditioning disc 4. During the conditioning operation it is possible to carry out conditioning over the entire surface of the polishing pad 2 by moving the conditioning disc 4 along the direction of the arrow A of FIGS. 1 and 2 (for example, reciprocating movement). This is because the polishing table 3 is rotating. In situ conditioning is then possible by carrying out the conditioning operation in parallel with the polishing operation.

Washing of the conditioning disc 4 is carried out by spraying washing water in the direction of the conditioning disc 4 from the washing water nozzle 6 in this state where the conditioning disc 4 is moved to the standby position W after the conditioning operation.

An example of specific timing for the conditioning operation and washing operation is described with reference to the timing charts of FIGS. 5A, 5B, and 5C. In FIGS. 5A, 5B, and 5C, horizontal axis is time.

For example, when the conditioning disc 4 is standing by in the standby position W only in the latter period of the polishing operation, as shown in FIG. 5A, after the conditioning operation starts at the same time as the polishing, the conditioning operation first ends. When the conditioning disc 4 then moves to the standby position W, washing water sprayed from the washing water nozzle 6 and the conditioning disc 4 is washed. After this, the polishing operation and the washing operation end.

When standing by of the conditioning disc 4 is intermittently repeated during the polishing operation, the timing chart becomes as shown in FIG. 5B. When the conditioning disc 4 only goes into standby once during the polishing operation, the timing chart becomes as shown in FIG. 5C.

In the above, an explanation is given where washing water is sprayed by the spraying mechanism so as to wash the conditioning disc 4 but rather than washing the conditioning disc 4 with pressurized sprayed washing water, it is also possible to perform spraying (for example, spraying a mist) so as to wet (moisture) the conditioning disc 4.

According to the first embodiment, there is provided the polishing table 3 having the polishing pad 2 on an upper surface, the polishing head 7 supporting the wafer 9 during polishing so as to bring the wafer 9 into contact with the polishing pad 2, the conditioning disc 4 for conditioning the polishing pad 2, the swing arm 5 capable of moving the conditioning disc 4 to the standby position W above the polishing pad 2, and the washing water nozzle 6 that sprays the conditioning disc 4 positioned at the standby position W with washing water and washes or wets the conditioning disc 4. It is therefore possible to wash or wet the conditioning disc 4 and suppress the affixing of slurry to the conditioning disc 4. It is therefore possible to suppress the occurrence of scratches to the wafer 9 caused by the falling of fixed matter.

It is also possible to spray the conditioning disc 4 with a liquid so as to wash or wet the conditioning disc 4 in a state where the conditioning disc 4 is moved to the standby position W above the polishing pad 2. It is therefore possible to substantially reduce the time required to move the conditioning disc 4 in order to wash or wet the conditioning disc 4 compared to the case where the conditioning disc 4 is moved to the side of the polishing table 3 to the positioned below the upper surface of the polishing table 3 every time the conditioning disc 4 is washed or wetted (Japanese Laid-Open Patent Publication No. H9-254018).

Further, even if fixed matter of the slurry becomes affixed to the conditioning disc 4, this fixed matter will not swept away to the side of the wafer 9 by the conditioning disc 4 while washing water is being sprayed by the washing water nozzle 6, and the problem where scratches occur on the wafer 9 is avoided. It is therefore possible to sufficiently suppress the occurrence of scratches on the wafer 9.

This means that it is possible to both shorten the time required to move the conditioning disc 4 in order to wash or wet the conditioning disc 4 and sufficiently suppress the occurrence of scratches on the wafer 9.

The conditioning disc 4 is also in standby above the polishing table 3. This means that it is possible to suppress delays in starting the conditioning after washing or wetting the conditioning disc 4. Namely, it is possible to suppress delays in the conditioning operation even when, for example, the duty of the conditioning operation with respect to the polishing operation is high and the frequency with which the conditioning disc 4 is on standby is also high (for example, as shown in FIG. 5B, when standby is repeated during a series of polishing operations).

The standby position W is above the edge portion of the polishing pad 2. It is therefore possible to keep the influence of the sprayed washing water on the polishing to a minimum.

The conditioning disc 4 positioned at the standby position W is rotated in the direction of the plate surface. It is therefore possible to wash or wet the entire surface of the conditioning disc 4 by spraying liquid only onto the portions of the conditioning disc 4 where the distance from the center of the polishing table 3 is equal to or longer than the distance between the center of the polishing table 3 and the center of the conditioning disc 4. It is therefore possible to make the influence of the sprayed washing water on the polishing extremely small.

The washing water nozzle 6 only sprays washing water. when the conditioning disc 4 is positioned at the standby position W. It is therefore possible to reduce waste of washing water and it is possible to reduce the amount of washing water that splashes onto the polishing pad 2.

Further, the washing water nozzle 6 is located to the side of the polishing table 3 and the washing water is sprayed at an incline upwards. This means that it is possible to spray washing water towards the conditioning disc 4 even if the washing water nozzle 6 is located so as not to interfere with the polishing table 3 and the polishing pad 2.

Figure 12:
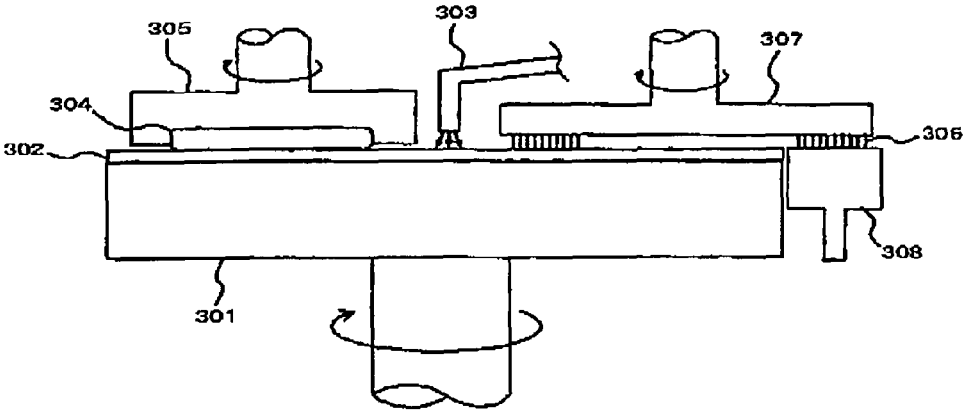
FIG. 12 RELATED ART
FIG. 12 is a front view in cross-section of a first polishing apparatus disclosed in Japanese Laid-Open Patent Publication No. 2000-263417.
Figure 13:
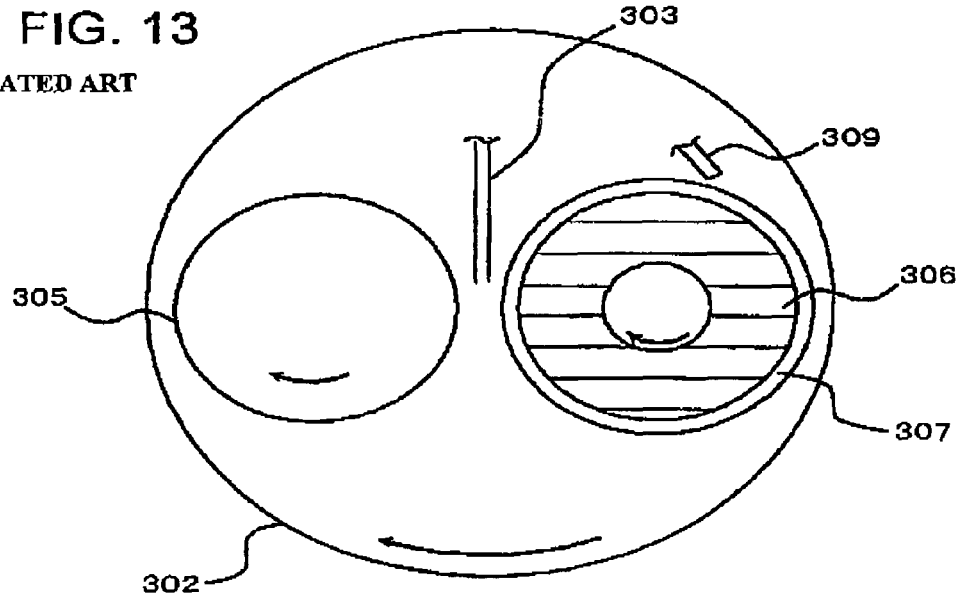
FIG. 13 RELATED ART
FIG. 13 is a plan view of a second polishing apparatus disclosed in Japanese Laid-Open Patent Publication No. 2000-263417.

The configurations in both FIGS. 12 and 13 in Japanese Laid-Open Patent Publication No. 2000-263417 neither disclose nor suggest mechanisms for moving the dresser 307. This means that, with the polishing apparatus of FIG. 12, it is not possible to carry out conditioning of the central part of the polishing pad 302 if the diameter of the dresser 307 is not at least more than the radius of the polishing table 301. This is because it is necessary to withdraw the brush 306 from the polishing table 301. The dimensions of the dresser 307 are therefore restricted. Similarly, with the polishing apparatus of FIG. 13, conditioning across the entire surface of the polishing pad 302 is not possible if the diameter of the dresser 307 is not substantially equal to the radius of the polishing table 301. This places restrictions on the dimensions of the dresser 307. With regards to this, in this embodiment, the swing arm 5 is capable of moving the conditioning disc 4 from the central portion to the edge portion of the polishing pad 2. It is therefore not necessary for the diameter of the conditioning disc 4 to be at least the radius of the polishing table 3 and it is also not necessary for this to be substantially the same as the radius of the polishing table 3. This makes it possible to ensure a degree of freedom for the dimension is of the conditioning disc 4. Specifically, for example, a conditioning disc 4 of a dimension that is smaller than the radius of the polishing table 3 is preferred.

[Second Embodiment]

Figure 6:
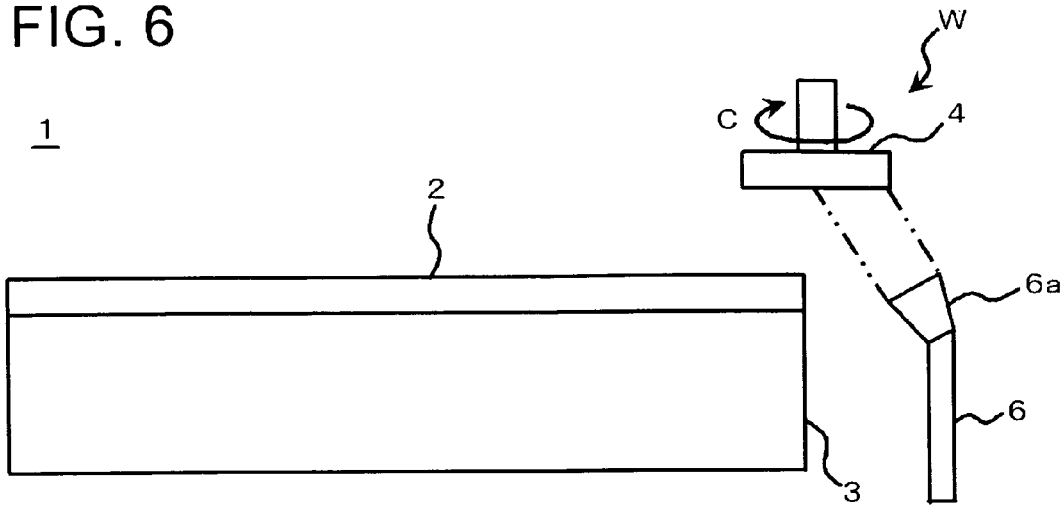
FIG. 6 is a front view showing a situation when washing a conditioning disc in the case of a second embodiment.

FIG. 6 is a front view showing a situation when washing the conditioning disc 4 in the case of a second embodiment.

In the first embodiment above, an explanation is given of an example where the whole of the conditioning disc 4 is positioned above the polishing pad 2 at the standby position W, as illustrated in FIGS. 1 and 3. However, in the second embodiment, part of the conditioning disc 4 is positioned to the outside of the polishing pads 2 at the standby position W, as illustrated in FIG. 6.

Specifically, for example, as illustrated in FIG. 6, the centre of the conditioning disc 4 is positioned to the outside of the polishing pad 2 at the standby position W. In this case, it is preferable to wash the portion positioned to the outside of the polishing pad 2 at the conditioning disc 4. The conditioning disc 4 is also rotating at the standby position W. This means that the entire surface of the conditioning disc 4 can be washed with the washing water by only spraying washing water on this portion.

According to the second embodiment, part of the conditioning disc 4 is positioned to the outside of the polishing pad 2 in the standby position W. It is therefore possible to keep the influence of the sprayed washing water on the polishing to a minimum. Further, it is also possible to make the influence of the sprayed washing water on the polishing dramatically smaller when the center of the conditioning disc 4 is positioned outside of the polishing pad 2 in the standby position W.

[Third Embodiment]

Figure 7A:
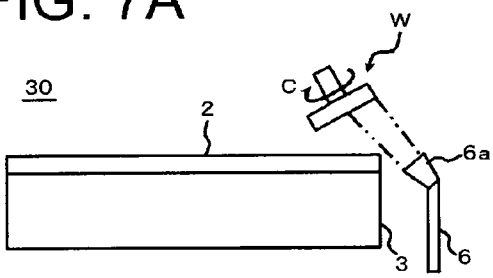
FIGS. 7A and 7B are front views of a CMP polishing apparatus of a third embodiment.
Figure 7B:
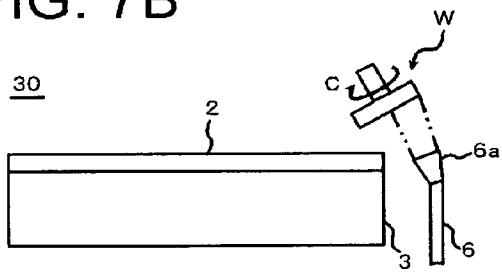
Figure 8:
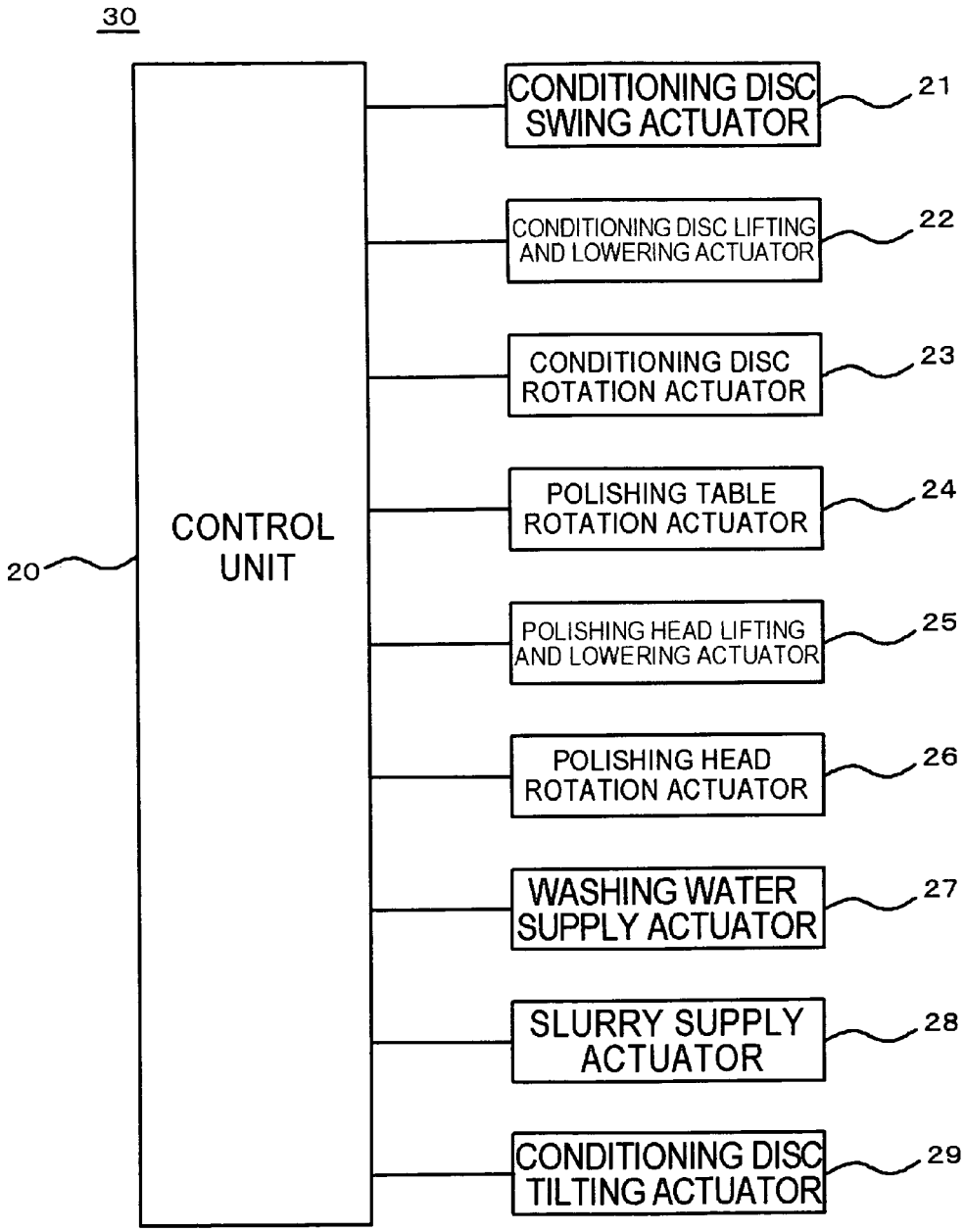
FIG. 8 is a block diagram of control for the CMP polishing apparatus of the third embodiment.

FIGS. 7A and 7B are front views of the CMP polishing apparatus (polishing apparatus) 30 of a third embodiment, and FIG. 8 is a block diagram of control of the CMP polishing apparatus 30.

In the case of this embodiment, as shown in FIGS. 7A and 7B, the posture of the conditioning disc 4 in the standby position W is adjusted so that the lower surface of the conditioning disc 4 faces towards the lateral direction (sideward) of the polishing table 3 in the standby position W. The adjustment of the posture is carried out as the result of a conditioning disc tilting actuator (moving mechanism) 29 acting under the control of the control unit 20 tilting the conditioning disc 4 via the swing arm 5. The conditioning disc tilting actuator 29 comprises, for example, a motor.

The operation of the conditioning disc tilting actuator 29 tilting the conditioning disc 4 can be carried out when the conditioning disc 4 is positioned at the standby position W or when the conditioning disc 4 is in the middle of going (rising) to the standby position W. In the case of this embodiment, the conditioning disc 4 that is in a tilted state is, for example, rotated by the conditioning disc rotation actuator 23.

According to the third embodiment, a moving mechanism (constructed, for example, from the swing arm 5, the conditioning disc swing actuator 21, the conditioning disc lifting and lowering actuator 22, and the conditioning. disc tilting actuator 29) adjusts the posture of the conditioning disc 4 in the standby position W so that the lower surface of the conditioning disc 4 faces towards the lateral direction of the polishing table 3. It therefore becomes easier for washing water sprayed from the washing water nozzle 6 to collide with the conditioning disc 4 and washing or wetting of the conditioning disc 4 can be carried out in a more appropriate manner. It is therefore possible for the center position of the conditioning disc 4 to be further from the center of the polishing pad 2 than in the first embodiment and the influence of the sprayed washing water on polishing can be further reduced.

In each of the above embodiments, an explanation is given taking the CMP polishing apparatus 1 and 30 as the polishing apparatus but the present invention can also be applied to polishing apparatus other than CMP polishing apparatus. The subject of polishing can also be that other than the wafer 9. An explanation is also given where a spraying mechanism is exemplified by a washing water nozzle 6 and washing water is sprayed as a liquid but it is also possible to spray washing liquid other than water or to spray a wetting agent.

What is claimed is:

1. A polishing apparatus, comprising:

a polishing table with a polishing pad on an upper surface;

a support unit supporting a subject of polishing while polishing said subject of polishing so that said subject of polishing comes into contact with said polishing pad;

a conditioning disc carrying out a conditioning of said polishing pad;

a moving mechanism comprising an actuator that moves said conditioning disc towards a standby position above said polishing pad; and a spraying mechanism spraying a liquid to said conditioning disc, positioned at said standby position so as to wash or wet said conditioning disc, while, in a plan view, a portion of said conditioning disc overlaps with said polishing table.

2. The polishing apparatus according to claim 1, wherein said standby position is above an edge portion of said polishing pad.

3. The polishing apparatus according to claim 2, wherein a part of said conditioning disc is positioned to an outside of said polishing pad at said standby position.

4. The polishing apparatus according to claim 1, further comprising a rotation mechanism rotating said conditioning disc positioned at said standby position in a plate face direction, wherein said spraying mechanism only sprays said liquid onto portions of said conditioning disc where a distance from a center of said polishing table is equal to or longer than a distance between said center of said polishing table and a center of said conditioning disc.

5. The polishing apparatus according to claim 1, wherein said moving mechanism comprises another actuator that adjusts a posture of said conditioning disc at said standby position so that a lower surface of said conditioning disc faces to a lateral direction of said polishing table at said standby position.

6. The polishing apparatus according to claim 1, wherein said spraying mechanism sprays said liquid only when said conditioning disc is positioned at said standby position.

7. The polishing apparatus according to claim 1, wherein said spraying mechanism is located to a side of said polishing table and sprays said liquid upwards at an incline.

8. The polishing apparatus according to claim 1, wherein said moving mechanism can move said conditioning disc in a state of contact with said polishing pad from a center portion of said polishing pad to an edge portion of said polishing pad.

9. A polishing method, comprising:

bringing a subject of polishing into contact with a polishing pad provided on an upper surface of a polishing table so as to polish said subject of polishing;

conditioning said polishing pad using a conditioning disc;

moving said conditioning disc to a standby position above said polishing pad; and spraying a liquid to said conditioning disc positioned at said standby position so as to wash or wet said conditioning disc, while, in a plan view, a portion of said conditioning disc overlaps with said polishing table.

10. The polishing apparatus according to claim 1, wherein if the conditioning disc is at the standby position, then the conditioning disc is over the polishing table.

11. The polishing apparatus according to claim 1, wherein if the conditioning disc is carrying out the conditioning of the polishing pad, then the spraying mechanism is not spraying the liquid to the conditioning disk.

12. The polishing apparatus according to claim 1, wherein the spraying mechanism comprises a spraying outlet that is inclined toward the polishing table.

13. The polishing apparatus according to claim 1, wherein the spraying mechanism sprays the liquid at an upward incline toward the conditioning unit.

14. The polishing apparatus according to claim 1, wherein the moving mechanism moves the conditioning disc from the standby position to a conditioning position, in which the conditioning disc carries out the conditioning of the polishing pad, by lowering the conditioning disc from the standby position to the conditioning position.

15. The polishing apparatus according to claim 1, wherein if the conditioning disc is at the standby position, then an edge of the conditioning disc is positioned inside an edge of the polishing pad.

16. The polishing apparatus according to claim 1, wherein if the conditioning disc is in contact with the polishing pad, then the conditioning disc is at a position that is below the standby position.

17. The polishing apparatus according to claim 1, wherein if the conditioning disc is at the standby position, then a first part of the conditioning disc is positioned outside of an edge said polishing pad and a second part of the conditioning disc is positioned inside the edge of the polishing pad.

18. A polishing apparatus, comprising:

a polishing table configured to house a polishing pad on an upper surface thereof;

a moving mechanism that is configured to move a conditioning disc into a plurality of positions including:

a polishing position which causes the conditioning disc to come into contact with the polishing pad; and a standby position that is above the polishing table; and a washing mechanism configured to cause a liquid to contact the conditioning disc, if the conditioning disc is at the standby position, while, in a plan view, a portion of the conditioning disc overlaps with the polishing table.

19. The polishing apparatus according to claim 18, wherein the polishing position of the conditioning disc is located at a lower position than the standby position of the conditioning disc.

20. The polishing apparatus according to claim 18, wherein if the conditioning disc is at the standby position, then a lower surface of the conditioning disc is above the upper surface of the polishing table.

* * * * *